US009061188B2

(12) United States Patent
Nathan

(10) Patent No.: US 9,061,188 B2
(45) Date of Patent: Jun. 23, 2015

(54) GOLF CLUB HANDLE TRAINING AID

(71) Applicant: Raghu Nathan, Bossier City, LA (US)

(72) Inventor: Raghu Nathan, Bossier City, LA (US)

( * ) Notice: Subject to any disclaimer, the term of this patent is extended or adjusted under 35 U.S.C. 154(b) by 0 days.

(21) Appl. No.: 14/185,535

(22) Filed: Feb. 20, 2014

(65) Prior Publication Data

US 2014/0235363 A1 Aug. 21, 2014

Related U.S. Application Data

(60) Provisional application No. 61/841,490, filed on Jul. 1, 2013, provisional application No. 61/766,767, filed on Feb. 20, 2013, provisional application No. 61/792,052, filed on Mar. 15, 2013.

(51) Int. Cl.

| | |
|---|---|
| ***A63B 69/36*** | (2006.01) |
| ***A63B 53/16*** | (2006.01) |
| ***A63B 59/00*** | (2015.01) |
| *A63B 71/06* | (2006.01) |

(52) U.S. Cl.

CPC ..... *A63B 53/16* (2013.01); *A63B 59/0074* (2013.01); *A63B 69/3632* (2013.01); *A63B 69/3685* (2013.01); *A63B 59/0025* (2013.01); *A63B 59/0029* (2013.01); *A63B 2071/0694* (2013.01)

(58) Field of Classification Search

USPC ..... 473/201, 203, 204, 219, 226, 300, 303, 473/579

See application file for complete search history.

(56) References Cited

U.S. PATENT DOCUMENTS

| | | | | | |
|---|---|---|---|---|---|
| 5,348,303 | A * | 9/1994 | Swissheim | 473/201 |
| D352,441 | S * | 11/1994 | Oury et al. | D8/303 |
| 5,511,790 | A * | 4/1996 | Duran | 473/201 |
| 6,656,054 | B2 * | 12/2003 | Ulrich | 473/201 |
| 7,407,444 | B2 * | 8/2008 | Cera | 473/300 |
| D593,716 | S * | 6/2009 | Strauss | D30/156 |
| 2003/0216192 | A1 * | 11/2003 | Chu | 473/300 |
| 2009/0048036 | A1 * | 2/2009 | Huang | 473/303 |

* cited by examiner

*Primary Examiner* — Nini Legesse

(57) ABSTRACT

A golf aid is provided. The golf aid includes a golf club handle having a grip. The grip may include a pattern. The pattern includes at least an upper diamond and a lower diamond. The upper diamond includes a plurality of small upper diamonds forming the upper diamond. The lower diamond includes a plurality of small lower diamonds forming the lower diamond.

14 Claims, 4 Drawing Sheets

GOLF CLUB HANDLE TRAINING AID

CROSS-REFERENCE TO RELATED APPLICATION

This application claims the benefit of priority of U.S. provisional application No. 61/841,490, filed Jul. 1, 2013, U.S. provisional application No. 61/766,767, filed Feb. 20, 2013, and U.S. provisional application No. 61/792,052, filed Mar. 15, 2013 the contents of which are herein incorporated by reference.

BACKGROUND OF THE INVENTION

The present invention relates to a training aid and, more particularly, to a golf club handle pattern training aid.

The correct method of gripping the golf club is not completely understood. If even one component of the grip is flawed the golf swing becomes erratic. The exact mechanism of the backswing and downswing, and the relationships of the biomechanical components and the sequence behind the swing mechanism is not well understood. This is the primary reason that players of all levels have difficulty maintaining consistency and performing to the best of their abilities. Although the concept of swing plane is well known, there is no method currently available that provide golfers with definite reference points to ensure integrity of the plane. They are forced to rely on a second set of eyes or video analysis to detect faults. This is inconvenient and does not allow real-time feedback that the golfer needs.

Current grip patterns are limited and vague and cannot offer the golfer a guide for the entire golf swing. They do not provide guidelines for set-up and ball position. They do not help players with strong and weak grips. Current solutions do not help the golfer to form the mechanically sound grip that is needed for the ideal swing. They do not provide the golfer landmarks that help keep the club in plane throughout the swing. Since the swing plane is three-dimensional and swing occurs in time, it is a four-dimensional entity and therefore needs five co-ordinates that should be available to the golfer. The ideal grip pattern will therefore need to be capable of ensuring the correct grip while providing five co-ordinates for the swing.

As can be seen, there is a need for an improved grip pattern that helps a golfer obtain a proper swing.

SUMMARY OF THE INVENTION

In one aspect of the present invention, a golfing aid comprises: a golf club handle comprising a grip; a pattern disposed on the grip, wherein the pattern comprises at least an upper diamond and a lower diamond, wherein the upper diamond comprises four small upper diamonds forming the upper diamond and intersecting at a center of the upper diamond, and the lower diamond comprises four small lower diamonds forming the lower diamond, and intersecting at a center of the lower diamond.

These and other features, aspects and advantages of the present invention will become better understood with reference to the following drawings, description and claims.

DETAILED DESCRIPTION OF THE INVENTION

Figure 1:
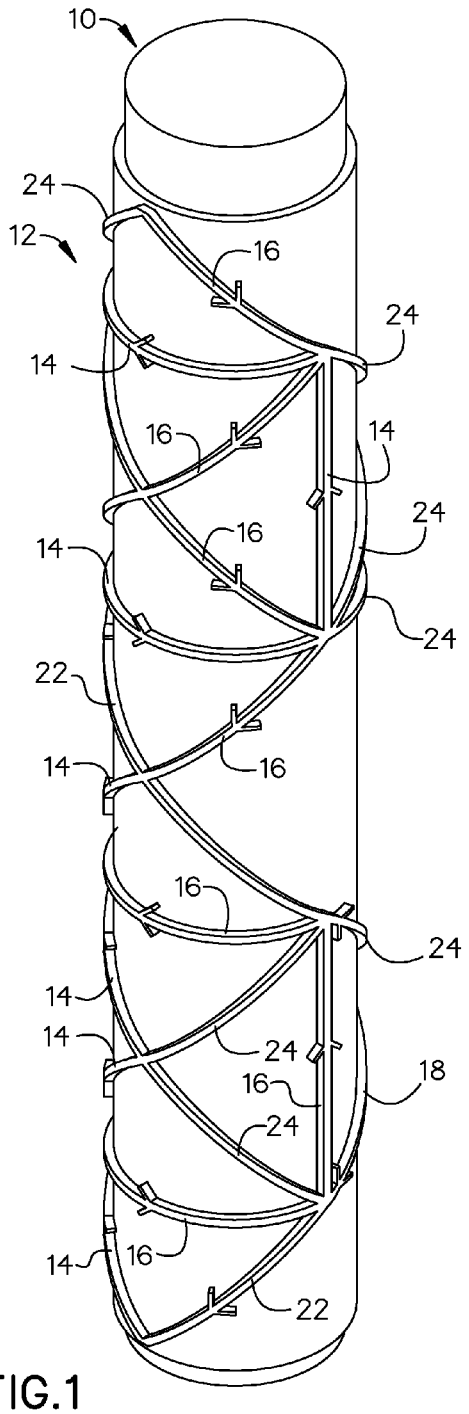
FIG. 1 is a front perspective view of the present invention shown on a golf club handle.
Figure 2:
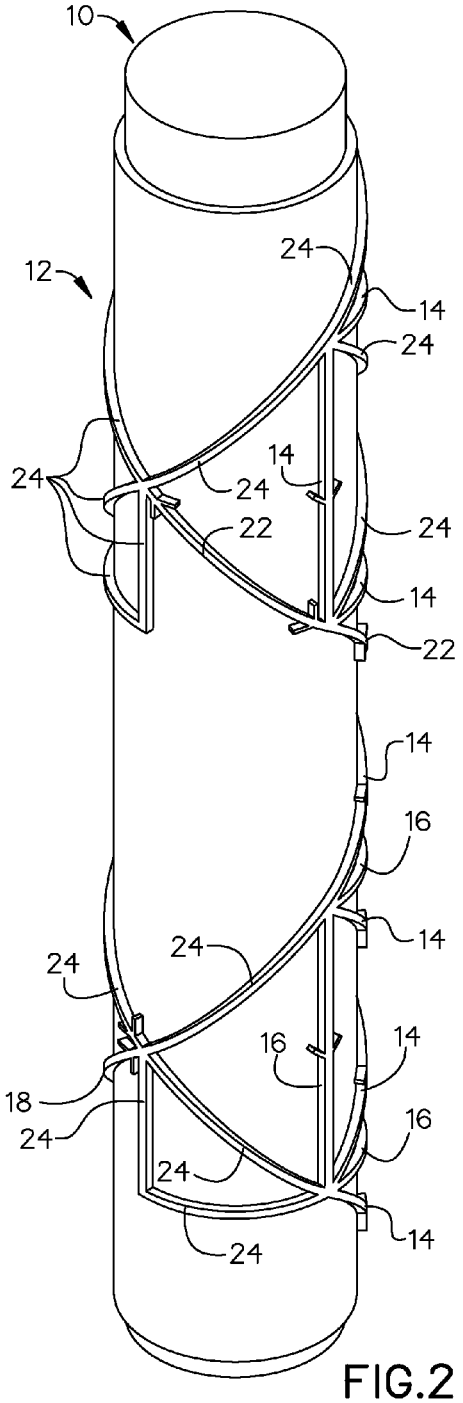
FIG. 2 is a rear perspective view of the present invention shown on a golf club handle.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a pattern imprinted on golf grips to enable the ideal grip technique and ideal golf swing. Current grip patterns are vague and inaccurate. The pattern of the present invention is based on a complete understanding of the entire swing mechanism which is an emergent phenomenon. Once understood and the elements brought together in the correct relationship and sequence, the present invention becomes self-organizing as most emergent phenomena do. The grip pattern of the present invention is comprehensive, customized to the golfers exact hand size and allows full understanding and execution of the correct grip and swing while providing five co-ordinates for the swing.

Referring to FIGS. 1 through 9, the present invention includes a golf aid. The golf aid includes a golf club handle 10 having a grip. The grip may include a pattern 12. The pattern includes at least an upper diamond 26 and a lower diamond 26. The upper diamond 26 includes a plurality of small upper diamonds 30 forming the upper diamond 26. The lower diamond 28 includes a plurality of small lower diamonds 32 forming the lower diamond 28.

In certain embodiments, the plurality of small upper diamonds 30 includes four small upper diamonds 30 intersecting at a center of the upper diamond 26. The four small lower diamonds 30 may include a small top diamond, a small bottom diamond, a small first side diamond, and a small second side diamond. The plurality of small lower diamonds 32 may include four small lower diamonds 32 intersecting at a center of the lower diamond 28. The four small lower diamonds 32 may includes a small top diamond, a small bottom diamond, a small first side diamond, and a small second side diamond.

In certain embodiments, the pattern 12 may further include an upper square 34. Each side of the upper square 34 passes through the center of a different small upper diamond 30. The pattern 12 may further include a lower square 36. Each side of the lower square 36 may pass through the center of a different small lower diamond 32.

The present invention may further include additional triangles on the pattern 12. For example, the pattern 12 may further include at least one first triangle 38 extending from and sharing one side of at least one of the small first side diamond and the small second side diamond of the upper diamond 26 and the lower diamond 28. The pattern 12 may further include at least a second triangle 40 extending from and sharing one side of the at least one first triangle 38, of the upper diamond 26 and the lower diamond 28.

The upper diamond 26, the lower diamond 28, the four small upper diamonds 30, the four small lower diamonds 32, the upper square 3, the lower square 36, the first triangle 38 and the second triangle 40 may be made of lines comprising different colors. For exemplary purposes, the present invention may include red lines 14, blue lines 16, purple lines 18, gold lines 20, green lines 22, and black lines 24. However, the colors may be interchangeable with patterns or any type of designation.

Figure 3A:
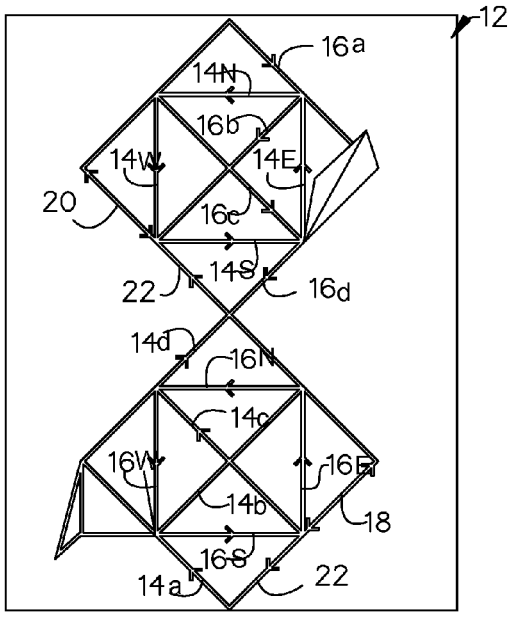
FIG. 3A is a front view of the present invention.
Figure 3B:
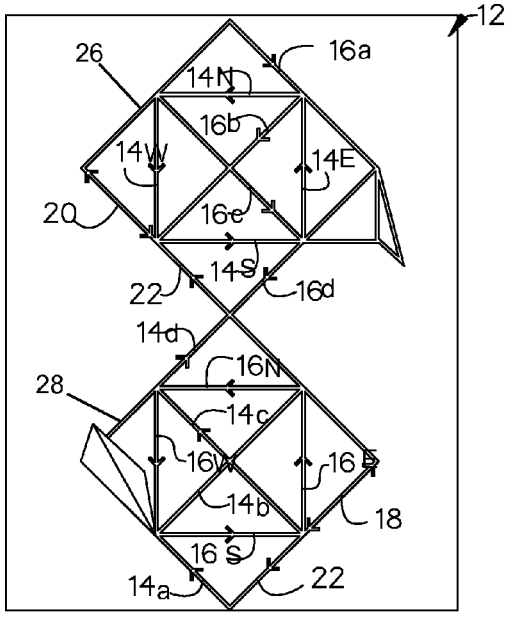
FIG. 3B is a front view of an alternate embodiment of the present invention.
Figure 4A:
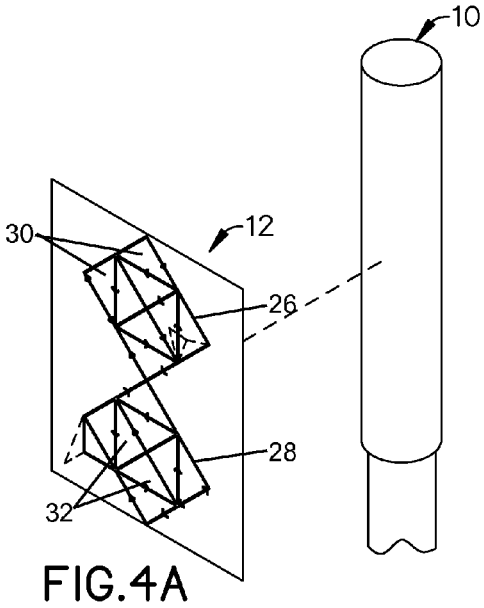
FIG. 4A is an exploded view of the present invention.
Figure 4B:
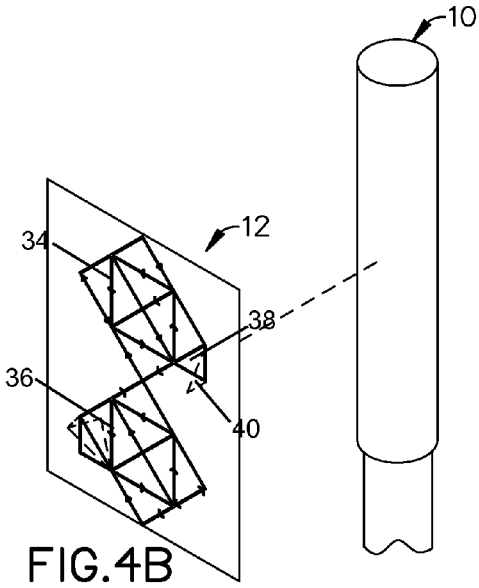
FIG. 4B is a front view of an alternate embodiment of the present invention.
Figure 5:
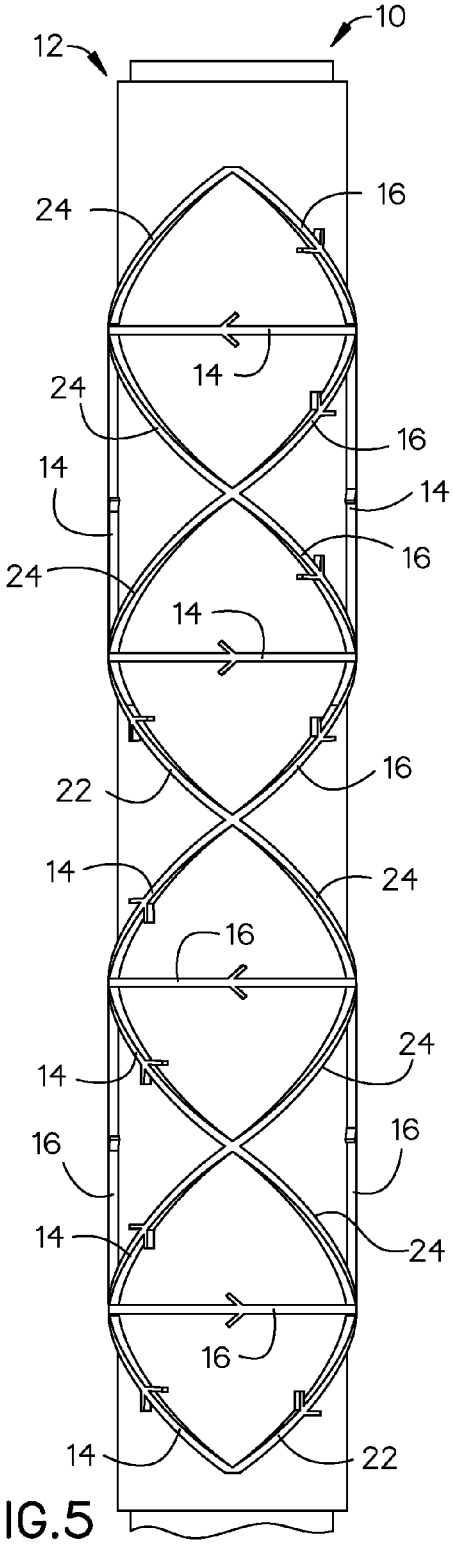
FIG. 5 is a front view of the present invention shown on a golf club handle.
Figure 6:
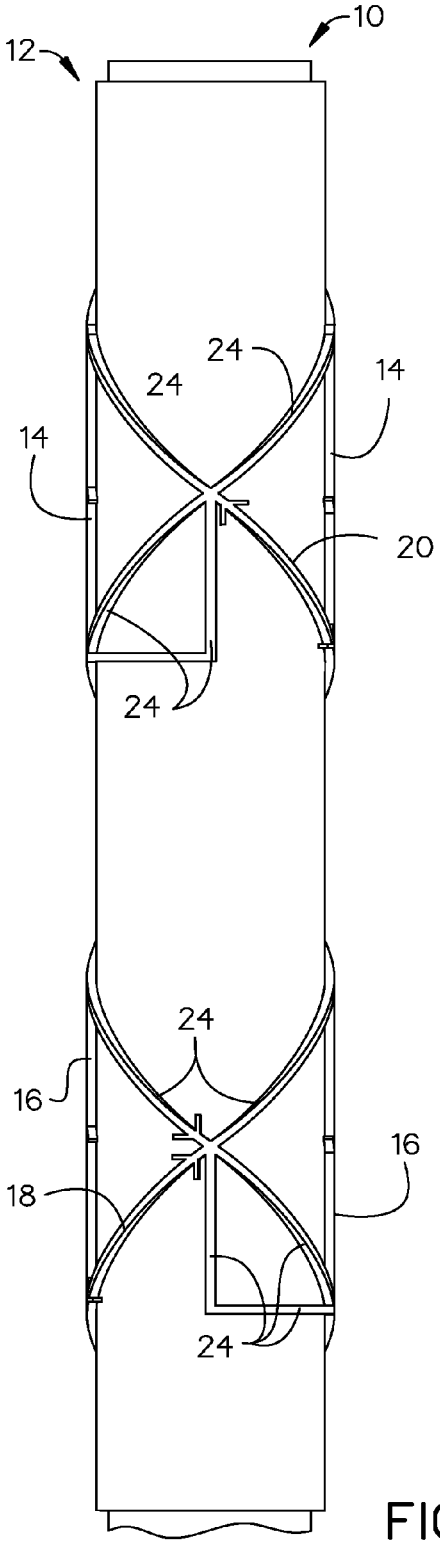
FIG. 6 is a side view of the present invention shown on a golf club handle.
Figure 7:
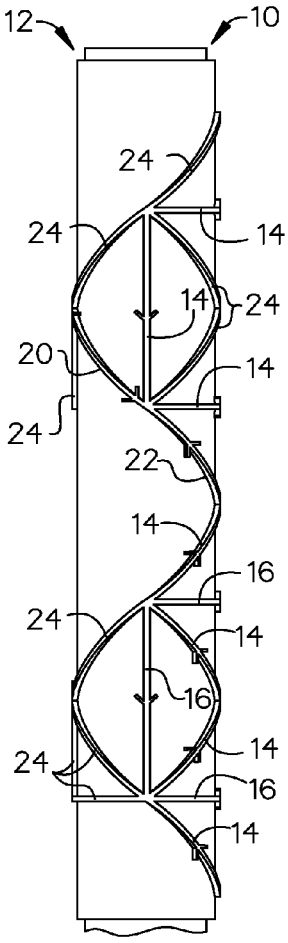
FIG. 7 is a side view of the present invention shown on a golf club handle.
Figure 8:
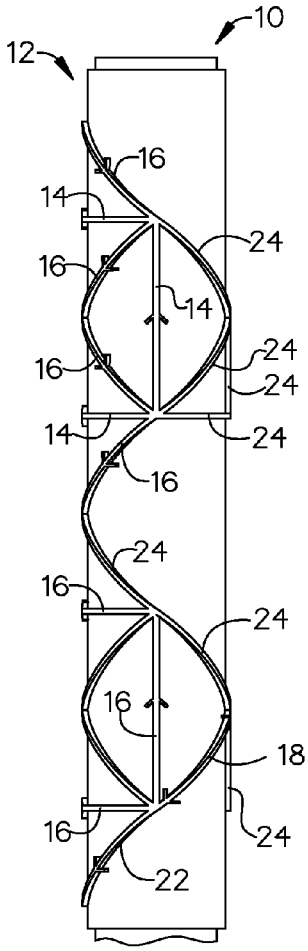
FIG. 8 is a back view of the present invention shown on a golf club handle.
Figure 9:
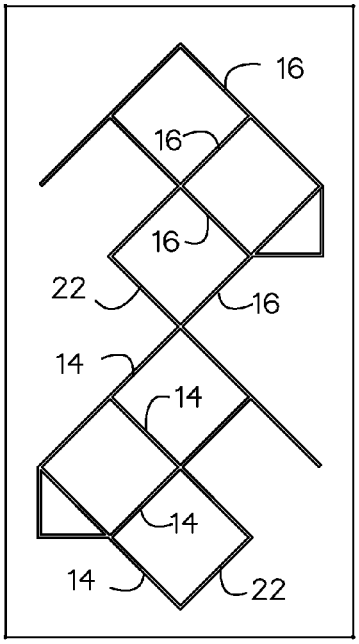
FIG. 9 is a front view of an alternate embodiment of the present invention.

As illustrated in FIGS. 3A and 3*b*, the red lines 14 may form the upper square 34 with lines 14N, 14E, 14S, and 14W. The red lines 14 may further create a zigzag through the lower diamond with lines 14*a*, 14*b*, 14*c*, and 14*d*. The ble lines 16 may form the lower square 36 with lines 16N, 16E, 16S, and 16W. The blue lines 16 may further create a zigzag through the lower diamond with lines 16*a*, 16*b*, 16*c*, and 16*d*.

To further describe the use of the present invention, letter indications are defined below. The letter A is axial, for rotational movement occurring in the neck and inside the pelvis. The primary muscles are Sterno mastoid, Trapezius and ilio psoas. The letter G is for the Gleno-Humeral component which is flexion and internal rotation of stable shoulder and extension of hip and knee on the other side. The letter C is cubital or elbow component. The letter T is torso or thoracic movement. The letter U is relaxation component of the large muscles such as Gluteals and Latissimus Dorsi that are aligned to the umbilicus.

The grip is based on pattern in the grip with back thumb flexed and front thumb extended. The zigzag of 14*a*, 14*b*, 14*c*, and 14*d* and the square of 14S, 14E, 14W and 14N are aligned to the swing plane that passes through the umbilicus and the front foot fifth toe. These components are passive and stay in the plane throughout.

For the backswing of the golfer, the square of 16E, 16N, 16W, 16S and the zigzag of 16*a*, 16*b*, 16*c*, and 16*d* are the active components and are aligned to the back thumb triangle 40 (hashed blue) along the y, z and x planes as outlined in the five stage sequence. The five stage sequence may include the following:

Stage 1: Back thumb with 16*a* segment in X plane; Back thumb with 16*e* segment in z plane Stage 2: Back thumb with 16*b* segment in x plane; Back thumb c edge with 16 n segment in z plane Stage 3: u gap with u gaps Stage 4: Back thumb with 16 c segment in x plane; Back thumb with 16 w segment in plane Stage 5: Back thumb with 16 d segment in x Plane; Back thumb with 16 s segment in z plane Thereby, the back thumb hashed triangle 40 stays in the swing plane and back thumb solid triangle 38 stays in loft plane throughout back swing. Note the motor sequence is T-C-U-G-A.

The transition to the downswing may include the following. Per description at the top of backswing the back thumb mid joint and 16*d* segment are in the x plane (i.e. parallel to ball-target line), the thumb joint mid line and 16S segment are in z plane (i.e. same horizontal level). To start the downswing the thumbs switch roles. The back thumb extends and the front thumb flexes and at the same time the front thumb mid joint line aligns with the 14*a* segment in the x plane (parallel to ball—target line) and the same joint line of the front thumb aligns with the 14S segment in the z plane (i.e. at the same horizontal level). This stage 1 of downswing as outlined in sequence.

Now the front thumb triangle 38 becomes aligned with the loft plane (solid) and the swing plane (Hashed). So the triangle representing the front half the front thumbnail stays in the same swing plane throughout the downswing along with the blue lower square 36 and blue zig zag 16*a-d*, which are the passive components of the downswing. The active components are the Red upper square 34 and the red zig zag 14*a-d* and along with the front thumb joint line progress in sequence as outlined in stages five stage sequences. The five stage sequence may include the following:

Stage 1: Front thumb with 14*a* segment in x plane; Front thumb with 14S segment in z plane Stage 2: Front Thumb with 14*b* segment in x plane; Front thumb with 14E segment in z plane Stage 3: u gap with u gaps Stage 4: Front thumb with 14*c* segment in x plane; Front thumb with 14N segment in z plane Stage 5: Front thumb with 14*d* segment in x plane Front thumb with 14W segment in z plane Note the active motor sequence now is A-G-U-C-T The pattern outlined on the grip, according to one embodiment of the present invention, helps the golfer grip the club in the correct manner and some of the important landmarks highlighted guide them throughout the swing to maintain the grip and the club in the proper position.

The correct golf swing is a complex non-linear dynamic system and requires ideal conditions at all times during the swing. By providing an elaborate pattern for the most accurate grip and guidelines for set-up, ball position and the plane, and the active and passive movements during the entire swing, this pattern helps in the execution of a consistent and repeatable swing. The double diamond grip pattern outlined helps with the adoption of the biomechanically ideal golf grip. It also provides landmarks for identifying ball position and the correct set-up.

According to one embodiment, the present invention provides landmarks for the entire swing by providing blue and red lines that guide the loft plane and swing plane components of the swing. The present invention provides blue and red dots that help to keep the swing connected to the core and in plane. The present invention provides blue and red rings that connect to the spine angle. The present invention provides blue and red arrows that give temporal reference points for the swing.

According to one embodiment, the present invention provides for a sound neutral grip and enables adoption of the correct set-up and ball position and execution of the correct biomechanics swing. By rotating the pattern 45 degrees clockwise or counterclockwise the pattern can be used by golfers using the strong and weak grips. Two pairs of connected Diamonds with alternating blue and redlines, are drawn on the grip as illustrated. The pattern when placed around the grip may result in the tips of each diamond meeting on the midline on the top surface of the grip. The diamonds are connected side by side and the common side ends in blue and red dots with one red dot and one blue dot located on the midline of the Bottom view. The other red dot and blue dot is located 90 degrees off on the cylindrical surface of the grip. The red and blue arrows represent the gap between the tips of thumb and index finger and are visible on the top view as shown.

Once the pattern is customized to the golfer's hand/finger size and imprinted on the grip, the golfer can be educated in a few minutes how the diamonds, lines, arrows, rings and dots help in the adoption of the correct grip/set up and execution of the correct swing. Since this is the natural (emergent) mechanism of the swing, the golfer will find it extremely easy to execute and repeat, powerfully and accurately. Once the basics are understood, even players with average motor skills can play at a very high level. Controlling spin and shaping shots become possible even for the amateur weekend golfer. The pattern of the present invention can be imprinted on the grips during manufacture or after the fact by using transfer tape technology using this design on pre-printed sheet that may be used in the transfer process.

The design can be reduced to the rings, dots, arrows and the blue and red lines. Holographic patterns can be used to improve the pattern and its visualization. Once the pattern is imprinted the golfer may use the lines, diamonds, arrows, dots, and rings to align the club to various landmarks of the body and follow a prescribed sequence based on these landmarks. The present invention, as described, may apply to left-handed golfers, and images and designs described may be mirrored to accommodate right-handed golfers.

It should be understood, of course, that the foregoing relates to exemplary embodiments of the invention and that modifications may be made without departing from the spirit and scope of the invention as set forth in the following claims. Once the grip pattern is imprinted, the golfer will use the landmarks to adopt the correct grip and make the correct swing according to the Paradigms swing system. This system uses multiple reference points that allow awareness of the loft plane, swing plane, the spine angle and the stable and dynamic cores involved in the swing. It makes the golfer aware of what needs to be constant, and the entire sequence of which muscle groups contract and which relax and how they control the club face and the swing

What is claimed is:

1. A golfing aid comprising:

a golf club handle comprising a grip;

a pattern disposed on the grip, wherein the pattern comprises at least an upper diamond and a lower diamond, wherein the upper diamond comprises four small upper diamonds forming the upper diamond and intersecting at a center of the upper diamond, and the lower diamond comprises four small lower diamonds forming the lower diamond, and intersecting at a center of the lower diamond, wherein the pattern further comprises an upper square, wherein each side of the upper square passes through a center of a different small upper diamond.

2. The golfing aid of claim 1, wherein the four small upper diamonds comprises a small top diamond, a small bottom diamond, a small first side diamond, and a small second side diamond.

3. The golfing aid of claim 2, wherein the pattern further comprises at least one first triangle extending from and sharing one side of at least one of the small first side diamond, and the small second side diamond.

4. The golfing aid of claim 3, wherein the pattern further comprises at least a second triangle extending from and sharing one side of the at least one first triangle.

5. The golfing aid of claim 1, wherein the four small lower diamonds comprises a small top diamond, a small bottom diamond, a small first side diamond, and a small second side diamond.

6. The golfing aid of claim 5, wherein the pattern further comprises at least one first triangle extending from and sharing one side of at least one of the small first side diamond, and the small second side diamond.

7. The golfing aid of claim 6, wherein the pattern further comprises at least a second triangle extending from and sharing one side of the at least one first triangle.

8. A golfing aid comprising:

a golf club handle comprising a grip;

a pattern disposed on the grip, wherein the pattern comprises at least an upper diamond and a lower diamond, wherein the upper diamond comprises four small upper diamonds forming the upper diamond and intersecting at a center of the upper diamond, and the lower diamond comprises four small lower diamonds forming the lower diamond, and intersecting at a center of the lower diamond, wherein the pattern further comprises a lower square, wherein each side of the lower square passes through a center of a different small lower diamond.

9. The golfing aid of claim 8, wherein the four small upper diamonds comprises a small top diamond, a small bottom diamond, a small first side diamond, and a small second side diamond.

10. The golfing aid of claim 9, wherein the pattern further comprises at least one first triangle extending from and sharing one side of at least one of the small first side diamond, and the small second side diamond.

11. The golfing aid of claim 10, wherein the pattern further comprises at least a second triangle extending from and sharing one side of the at least one first triangle.

12. The golfing aid of claim 8, wherein the four small lower diamonds comprises a small top diamond, a small bottom diamond, a small first side diamond, and a small second side diamond.

13. The golfing aid of claim 12, wherein the pattern further comprises at least one first triangle extending from and sharing one side of at least one of the small first side diamond, and the small second side diamond.

14. The golfing aid of claim 13, wherein the pattern further comprises at least a second triangle extending from and sharing one side of the at least one first triangle.

* * * * *